US005287917A

United States Patent [19]

Cannata

[11] Patent Number: 5,287,917

[45] Date of Patent: Feb. 22, 1994

[54] HEAT EXCHANGER

[76] Inventor: Antonio Cannata, 14 Patience Crescent, London, Ontario, Canada, N6E 2K9

[21] Appl. No.: 17,791

[22] Filed: Feb. 16, 1993

[51] Int. Cl.[5] ..... F28D 7/10; F28F 1/42

[52] U.S. Cl. ..... 165/154; 165/41; 165/179

[58] Field of Search ..... 165/164, 154, 179, 41, 165/141

[56] References Cited

U.S. PATENT DOCUMENTS

| | | | |
|---|---|---|---|
| 2,757,518 | 8/1956 | Schofield | 165/179 |
| 3,018,544 | 1/1962 | Whistler, Jr. | 165/179 |
| 3,528,494 | 9/1970 | Levedahl | 165/179 |
| 3,751,884 | 8/1973 | Hathorn | 165/179 |
| 3,835,923 | 9/1974 | Platell | 165/179 |
| 4,235,286 | 11/1980 | Behlau | 165/164 |
| 4,368,777 | 1/1983 | Grasso | 165/154 |
| 4,705,106 | 11/1987 | Hornack et al. | 165/179 |
| 5,071,627 | 12/1991 | Child et al. | 165/154 |

FOREIGN PATENT DOCUMENTS

| | | | |
|---|---|---|---|
| 800248 | 9/1950 | Fed. Rep. of Germany | 165/154 |
| 1004016 | 3/1952 | France | 165/179 |
| 133597 | 10/1981 | Japan | 165/179 |
| 1244469 | 7/1986 | U.S.S.R. | 165/179 |
| 537733 | 7/1941 | United Kingdom | 165/179 |

*Primary Examiner*—John Rivell
*Assistant Examiner*—L. R. Leo
*Attorney, Agent, or Firm*—Baker & Daniels

[57] ABSTRACT

A heat exchanger having a core comprising a conduit, a plurality of heat conducting elements extending transversely through the conduit and having portions projecting outwardly on each side of the conduit, a plurality of fins spaced along the length of said portions, and a housing enclosing said conduits and heat conducting elements, means for directing a medium to be heated or cooled through said conduit, and means for inducing a flow of heat exchanging medium through said housing and over said heat conducting elements and fins.

10 Claims, 2 Drawing Sheets

HEAT EXCHANGER

This invention is concerned with heat exchangers and particularly but not necessarily exclusively, it is concerned with a heat exchanger for incorporation in an automotive vehicle.

Conventional automotive radiators are large, generally rectangular structures comprising a pair of headers between which a core of finned tubes extends. Coolant is circulated between the engine block and the radiator and it is cooled by air passing through the core. The air flow is assisted by a fan either pushing or pulling the air through the core. Even when cowled the conventional radiator is inefficient and necessarily is large. It significantly contributes to the frontal aspect of the vehicle and limits streamlining.

The problem is particularly acute with commercial vehicles especially tractor trailer rigs. It has been calculated that almost fifty percent of the energy to move such a rig down the road at legal speeds is spent in overcoming wind resistance. Wind resistance or drag is determined primarily by the size and shape of the front surface of the vehicle. The front of a typical tractor trailer accounts for about 75% of the total aerodynamic drag. Air turbulence at the rear of the tractor contributes about 15% and skin friction the remaining 10%.

Attempts have been made to streamline the tractor but they have been limited by length and hence cargo space considerations.

As noted hereabove, the conventional radiator dictates the extent to which streamlining is possible. In fact from grille to engine block, there is as much as two feet of length lost to the radiator, the cowl, fan and motor.

With a conventional radiator, the air issuing from the fan, heated as it passes through the radiator is of course directed onto the vehicle engine. This feature of course adds heat load to the radiator and is a contributing factor in determining the size of radiator needed for a particular vehicle.

Additional problems arise with conventional radiators. Dust, bugs, gravel, leaves and paper tend to plug the openings between the fins and reduce the capacity of the radiator to cool the engine. Also, in cold weather, it is common to use shutters, grille covers or even shutters improvised from cardboard to ensure that optimum engine temperature can be reached and the driver's compartment to be heated. This puts additional load on the fan which is, of course, transferred to the engine.

The present invention seeks to provide a small and efficient heat exchanger. According to one aspect of this invention, there is provided a heat exchanger having a core comprising at least one conduit, a plurality of heat conducting elements extending transversely through the conduit and having portions projecting outwardly on each side of the conduit, a plurality of fins spaced along the length of said portions, and a housing enclosing said conduits and heat conducting elements, means for directing a medium to be heated or cooled through said conduit, and means for inducing a flow of heat exchanging medium through said housing and over said heat conducting elements and fins. Preferably, the heat exchanging medium and the medium to be heated or cooled are caused to flow in counter current.

The heat conducting elements are preferably blind tubes and desirably they are open to the interior of the conduit.

According to another aspect of this invention there is provided a heat exchanger having an inlet header for medium to be cooled or heated and an outlet header for that medium, a plurality of conduits extending between the headers, a housing for each conduit, a plurality of heat conducting elements extending transversely through said conduits and into the space between the conduits and the respective housings and having fins within that space, an inlet header for heat exchanging medium and an outlet header for that medium each of the latter two headers communicating with said housings.

The flow of medium through the conduits is rendered turbulent as it passes those portions of the heat conducting elements inside the conduits and the flow through the housing is made turbulent by the heat conducting elements and the fins.

With such an arrangement used in a vehicle, the medium to be cooled or heated would be engine coolant and/or engine oil. The heat exchanging medium would be air and it would be delivered by a fan.

The capacity of the radiator could of course be adjusted by increasing the number of conduits or increasing in length.

Having regard to the efficiency of the heat exchanger and its independence of air flow striking the vehicle, the unit would be significantly smaller than conventional radiators and could be disposed in any convenient location and orientation. Thus it could be located horizontally and transversely of the vehicle close to the front bumper. This would permit the shape of the front of the vehicle to be radically redesigned to improve drag coefficient.

Embodiments of the invention are illustrated schematically in the accompanying drawings in which.

Figure 1:
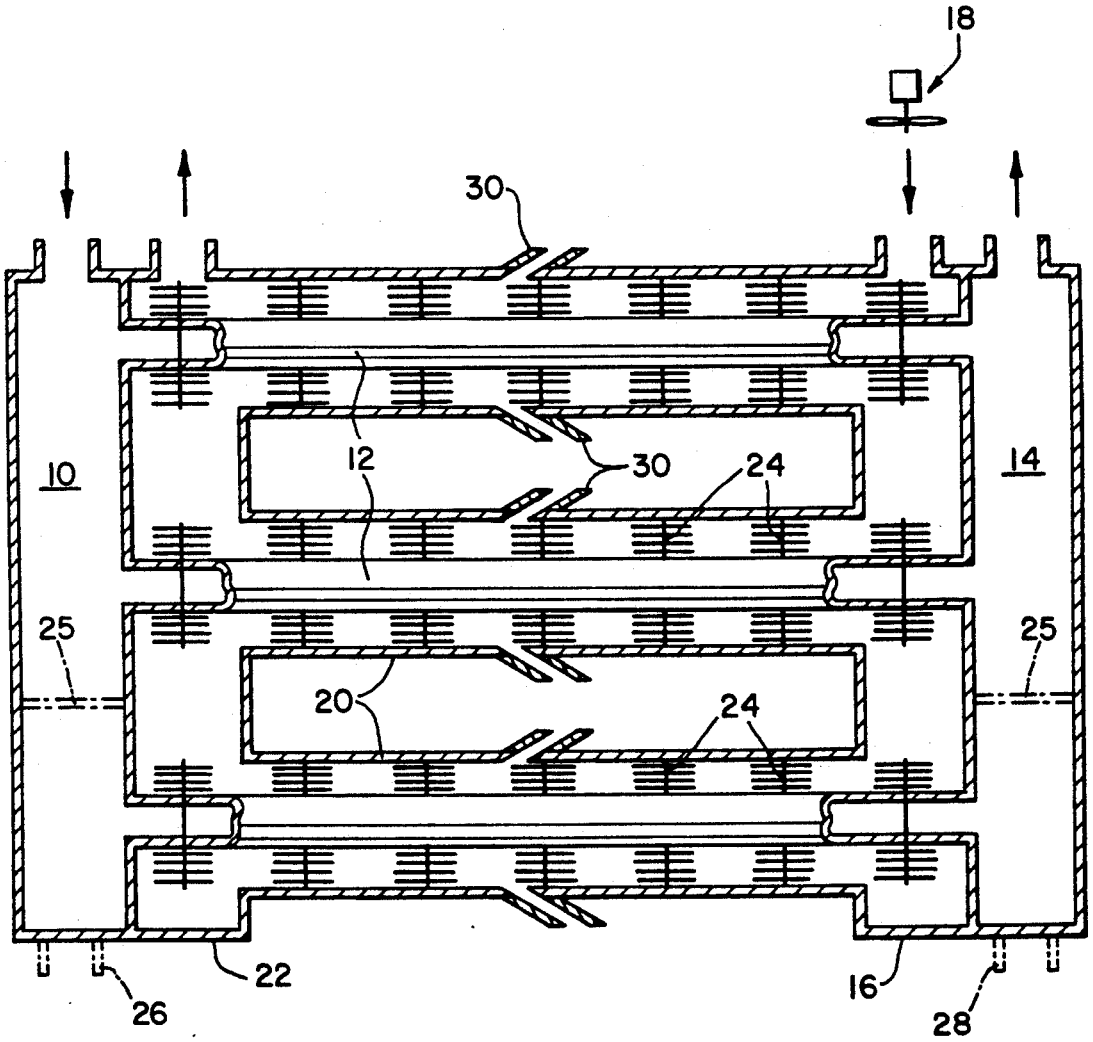
FIG. 1 is a side view, partially broken away, of a heat exchanger according to this invention.
Figure 3:
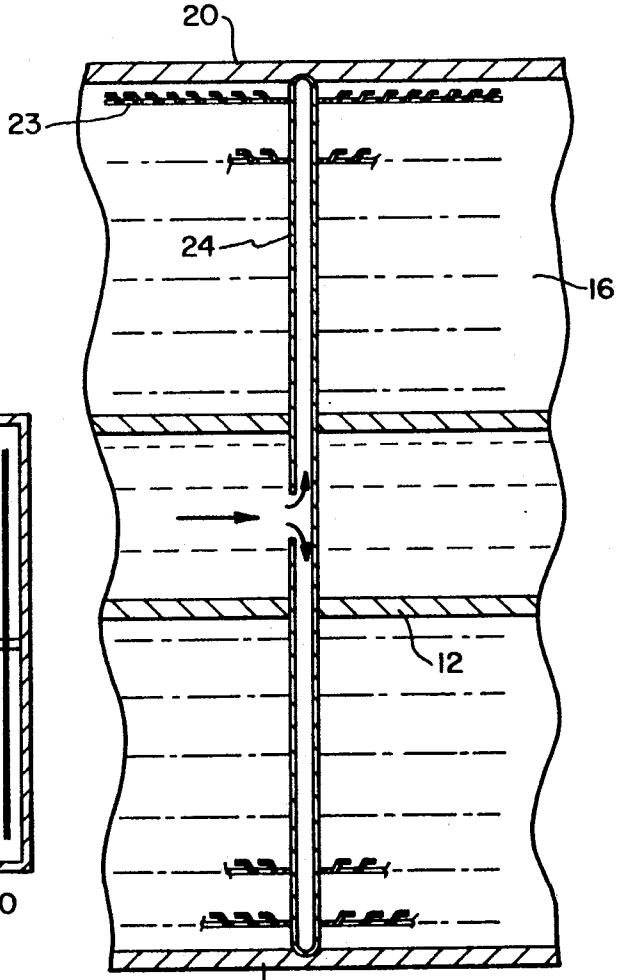
FIG. 3 is a cross sectional detail of the heat exchanger of FIG. 1.

The heat exchanger of FIG. 1 is for use with an automotive vehicle and is described with reference to that environment.

The heat exchanger comprises an inlet header 10 for receiving engine coolant and/or, as described hereinafter, engine oil or transmission fluid. A plurality of conduits 12 extend between header 10 and an outlet header 14 from whence coolant is returned to the engine block.

A cooling air inlet header 16 is disposed adjacent header 14 and it receives air from a fan indicated schematically at 18. A plurality of housings 20 extend from header 16 to outlet header 22, the housings extending co-axially with their associated conduits. The air issuing from outlet header 22 is preferably directed to a location on the vehicle such as the brakes so that in wet and cold conditions, the brakes may be warmed. It might also be ducted to the cargo space of a vehicle to keep chickens or other livestock warm in cold weather. Means would be provided to redirect the air in warm weather.

A plurality of heat exchanging elements 24, is disposed in each conduit 12. These each comprise a blind-ended tube extending diametrically through the conduits to the interior wall of the housings 20, preferably, internally of the conduits the tubes have openings. A plurality of fins 23 are disposed on those portions of the tubes in the space between the conduits and the housings.

Figure 5:
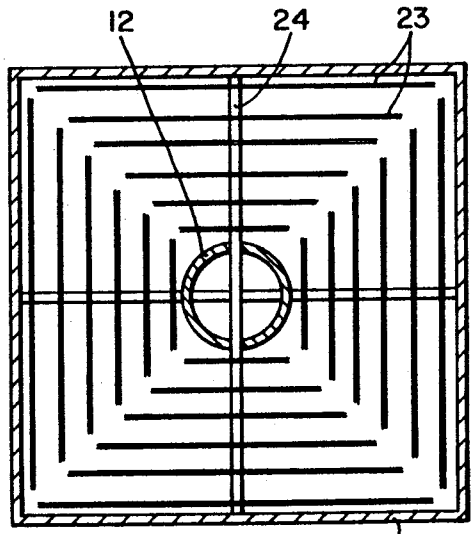
FIG. 5 is a cross sectional view of an alternative heat exchanger.
Figure 2:
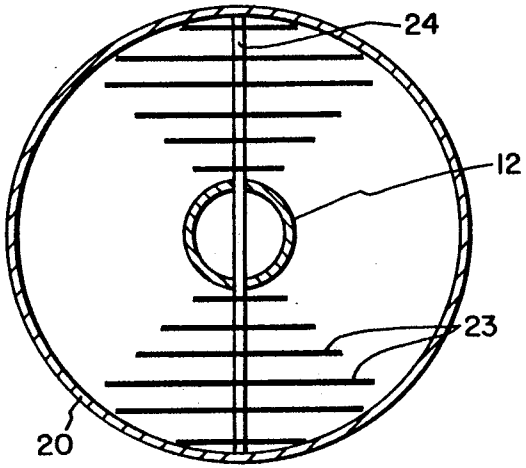
FIG. 2 is a cross section of the heat exchanger of FIG. 1.
Figure 4:
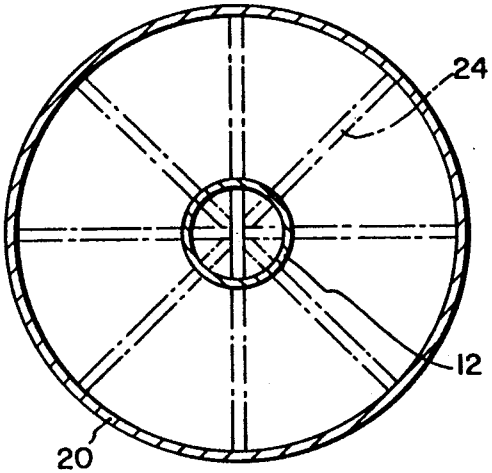
FIG. 4 is a cross section of the heat exchanger of FIG. 1 with parts omitted for clarity.

The fins are louver-like and have discontinuous upset portions which are designed to maximize contact between the fins and the cooling air and to cause the flow over the fins to be turbulent. The tubes are angularly offset from one another along the length of the conduits preferably in such a way as to induce a spiral flow of air through the space between the conduits and the housings. The housing 20 can be of circular section as shown in FIGS. 2 and 4 or it may be of square section as shown in FIG. 5 or, indeed of any other section. As shown in FIGS. 2, 4 and 5, the fins are large, together covering approximately, one quarter of the cross sectional area of the housing.

It will be appreciated that the tubes, passing through the conduits and being angularly offset from one another will cause the flow of coolant through the conduits to be turbulent.

Midway along the housings, included nozzle means are provided so the flow of air will induce a secondary flow of cooler air into the space between the conduits and the housings.

In a co-pending application of the applicant herein, filed of even date herewith, there is described a heating and cooling system for an internal combustion engine. That application describes the preheating of engine coolant and/or lubricating oil during engine warm-up. In it, during warm-up, exhaust gases are passed through a heat exchanger. When the engine is warm, the exhaust gases bypass the heat exchanger and cooling air is blown through the heat exchanger.

The heat exchanger of the present invention is of particular value in such an arrangement. The disclosure of the co-pending application is incorporated herein by this specific reference.

If it is desired to cool or heat two media, for example coolant and engine oil it is possible to partition the headers 10 and 14 as indicated in chain line at 25 and in that case an additional inlet 26 and an outlet 28 would be provided in the headers.

It is found that this heat exchanger is very efficient and that when installed in an automotive vehicle such as, for example, a tractor of a tractor-trailer rig, it can be disposed in a location out of the air flow the tractor as it travels. It could for instance, be disposed behind the cab but another location would be with the device disposed transversely and horizontally in the region of the front bumper of the vehicle. This would minimize, plumbing in a retrofit application and would permit significant advantages in streamlining to reduce drag and increase efficiency. By eliminating the conventional radiator, the truck is easily streamlined without sacrificing length.

The particular embodiments of the invention illustrated have been described with particular reference to their use in cooling engine coolant in an automotive vehicle. It is to be understood that equally it could be used to cool engine oil or transmission fluid. It could also be used to heat up any of those fluids during engine warm up by directing exhaust gases generated by the engine to the heat exchanger. This arrangement is more particularly described in a co-pending application filed on even date herewith and entitled HEATING AND COOLING SYSTEM FOR AN INTERNAL COMBUSTION ENGINE.

We claim:

1. A heat exchanger having a core comprising a plurality of heat conducting elements extending transversely through a conduit and having portions projecting outwardly on each side of the conduit, a plurality of fins spaced along said portions, a housing enclosing said conduit and heat conducting elements, means for directing a flow of a medium to be heated or cooled through said conduit and means for inducing a flow of a heat exchanging medium through said housing and across said fins, said heat conducting elements being blind-ended tubes and said tubes having an opening within said conduit.

2. A heat exchanger as claimed in claim 1 wherein said means for inducing a flow through the housing and said means for directing a flow through said conduit are arranged to produce counterflows.

3. A heat exchanger as claimed in claim 1 wherein said fins are discontinuous.

4. A heat exchanger as claimed in claim 3 wherein said fins have louver-like openings.

5. A heat exchanger as claimed in claim 1 wherein said housing has nozzle means intermediate its ends through which the flow of heat exchanging medium induces a secondary flow of heat exchanging medium from the exterior of the housing to its interior.

6. A heat exchanger comprising an inlet header for receiving a medium to be heated or cooled, an outlet header for the medium and a plurality of conduits extending between said headers, a housing for each conduit co-axial with their respective conduits and defining spaces between the exterior surfaces of the conduits and the interior of the housings, a plurality of heat exchanging elements longitudinally spaced along the conduits and extending through the conduits and into said spaces, a plurality of fins on portions of said elements within the spaces and means for inducing a flow of heat exchanging medium through said spaces.

7. A heat exchanger as it is claimed in claim 6 comprising an inlet header for heat exchanging medium and an outlet header for said heat exchanging medium said housings communicating with said headers and fan means for producing a flow between said headers.

8. A heat exchanger as described in claim 6 wherein said heat exchanging elements extend fully across said spaces and are secured to said housings.

9. A heat exchanger as described in claim 6 wherein said heat exchanging elements are blind-ended tubes.

10. A heat exchanger as described in claim 9 wherein said tubes have openings internally of said conduits.

* * * * *